US008635933B2

(12) United States Patent
Hale

(10) Patent No.: US 8,635,933 B2
(45) **Date of Patent: *Jan. 28, 2014**

(54) SCREWSTRIP ADVANCE MECHANISM AND FEEDER FOR A POWER SCREWDRIVER

(75) Inventor: Troy Hale, Goodlettsville, TN (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/584,564

(22) Filed: Aug. 13, 2012

(65) Prior Publication Data

US 2013/0036876 A1 Feb. 14, 2013

Related U.S. Application Data

(63) Continuation of application No. 12/731,886, filed on Mar. 25, 2010, now Pat. No. 8,240,232.

(51) Int. Cl.
*B25B 23/06* (2006.01)
*B25B 23/00* (2006.01)
*B25B 23/04* (2006.01)

(52) U.S. Cl.
CPC ..... *B25B 23/00* (2013.01); *B25B 23/045* (2013.01)
USPC ..... 81/434; 81/57.37

(58) Field of Classification Search
USPC ..... 81/57.37, 434, 433, 435; 227/102, 128, 227/136; 29/809
See application file for complete search history.

(56) References Cited

U.S. PATENT DOCUMENTS

| | | | | |
|---|---|---|---|---|
| 3,960,191 | A | 6/1976 | Murray | |
| 4,014,225 | A * | 3/1977 | Lejdegard et al. | 81/434 |
| 4,201,324 | A | 5/1980 | Maier et al. | |
| 4,581,964 | A | 4/1986 | Takatsuru | |
| 5,829,661 | A | 11/1998 | Hirtl et al. | |
| 6,138,535 | A * | 10/2000 | Jalbert et al. | 81/434 |
| 6,230,594 | B1 * | 5/2001 | Jalbert et al. | 81/434 |
| 6,328,746 | B1 | 12/2001 | Gambale | |
| 6,904,834 | B2 | 6/2005 | Lin | |
| 7,165,481 | B2 * | 1/2007 | Kikuchi | 81/434 |
| 7,896,212 | B2 * | 3/2011 | Uejima et al. | 227/136 |
| 8,240,232 | B2 * | 8/2012 | Hale | 81/434 |
| 2008/0210734 | A1 | 9/2008 | Uejima et al. | |
| 2008/0216607 | A1 | 9/2008 | Xu | |

FOREIGN PATENT DOCUMENTS

EP 1932623 A1 6/2008

OTHER PUBLICATIONS

Invitation to Pay Additional Fees and Partial International Search Report dated Jun. 28, 2011 in International Application No. PCT/US2011/029901.
Notice of Allowance and Fee(s) Due dated Apr. 12, 2012 in U.S. Appl. No. 12/731,886.
Response to Written Opinion filed in European Patent Application No. 11712435.4, dated Jun. 3, 2013.

* cited by examiner

*Primary Examiner* — David B Thomas
(74) *Attorney, Agent, or Firm* — Vierra Magen Marcus LLP

(57) ABSTRACT

A power screwdriver is disclosed including a screw advance mechanism for advancing a screwstrip, and a hinged feed track for feeding the screwstrip to the screw advance mechanism.

17 Claims, 15 Drawing Sheets

SCREWSTRIP ADVANCE MECHANISM AND FEEDER FOR A POWER SCREWDRIVER

CLAIM OF PRIORITY

This application is a continuation application of U.S. patent application Ser. No. 12/731,886, entitled "SCREWSTRIP ADVANCE MECHANISM AND FEEDER FOR A POWER SCREWDRIVER," filed Mar. 25, 2010, which application is incorporated herein by reference in its entirety.

BACKGROUND

1. Field

The present technology relates to mechanisms for feeding and advancing a screwstrip with respect to a power screwdriver.

2. Description of the Related Art

Collated screwstrips are known in which the screws are connected to each other by a retaining strip of flexible plastic material. Such strips are taught, for example, by U.S. Pat. No. 4,167,229, entitled "Screw Strip and Method For Forming The Same," and U.S. Patent Publication No. 2010/0032326, entitled "Screwstrip With Drive Slots Having Angled Sidewalls," each of which is incorporated by reference herein in its entirety. Screws carried in such screwstrips are adapted to be successively and incrementally advanced to a position, referred to herein as the target position, in alignment with a bit of a reciprocating, rotating power screwdriver. Once a screw within the strip is properly aligned in the target position, the bit engages the screw and drives it into a workpiece. In the course of the bit engaging a screw and driving it into a workpiece, the screw becomes detached from the plastic strip, leaving the strip as a continuous length.

Known power screwdrivers for driving such collated screwstrips include, for example, U.S. Pat. No. 7,341,146 entitled "Screwdriver With Dual Cam Slot For Collated Screws," and U.S. Pat. No. 6,164,170, entitled "Semi-Automatic Screwdriver For Collated Screws." Such known power screwdrivers include a rotatable and reciprocally moving screwdriver shaft which is turned in rotation by an electric motor. A screwdriving bit forms a forwardmost portion of the shaft for engaging the head of each successive screw as each screw is moved into the target position, axially aligned under the screwdriver shaft.

An important aspect of such a power screwdriver is the manner and accuracy with which the screws are advanced and located in the target position. A screw must be properly aligned axially under the screwdriver shaft for successful initial and continued engagement between the bit and the screw head in driving a screw fully down into a workpiece. Screw advance mechanisms are known including a feed lever which engages within slots in the screwstrip to advance the strip in a stepped fashion. Once the feed lever has advanced the screwstrip to its forwardmost position for a given cycle, a screw in the screwstrip is aligned with the screwdriver head and the screw is inserted by the screwdriver into the workpiece. Thereafter, the feed lever moves rearward to engage the next slot in the screwstrip to advance the screwstrip to position the next screw for insertion.

One problem which exists with conventional screw advance mechanisms for use with flexible screwstrips is the ability to accurately position the respective screws in the target position. Occasionally the advance mechanism will under or overfeed the strip resulting in a misalignment of the screw bit with the next screw to be driven. It may also happen that a misaligned screw will be skipped altogether. In addition to alignment problems, it is often difficult to load a screwstrip into the screwdriver and advance it to a position where screws are ready for insertion.

SUMMARY

Embodiments of the present technology relate to a power screwdriver including a screw advance mechanism for advancing a screwstrip, and a feeder mechanism for feeding the screwstrip to the screw advance mechanism. The screw advance mechanism includes a number of components which cooperate with each other to accurately advance a screwstrip to position each screw within the screwstrip in the target position for insertion into a workpiece. These components include a feed lever, a lifter, a clutch slider and a paddle lever. In general, these components interact with each other to accomplish a number of functions with respect to the screwstrip.

In a first of such functions, the components of the screw advance mechanism advance a screwstrip one position at a time to position each screw in the screwstrip in the target position. It may happen that portions of a screwstrip may be devoid of screws, such as for example at the beginning of a screwstrip. It is a further function of the components of the screw advance mechanism to allow the screwstrip to be easily advanced to a position where a screw is at or adjacent to the target position, while preventing the screwstrip from being pulled out in the opposite direction. It is another function of the components of the screw advance mechanism to lock a screwstrip in position while a screw is in the target position so that it remains in that location for driving by the power screwdriver. There are also times when it is desired to remove or reposition a screwstrip. It is another function of the screw advance mechanism to allow manual disengagement of all components with the screwstrip so that the screwstrip may be easily repositioned.

The feed track is provided to feed and position the screwstrip with respect to the screw advance mechanism. The feed track of the present technology is formed into two halves which are connected by a spring-biased hinge. In this configuration, the feed track is able to perform its function of feeding the screwstrip to the screw advance mechanism. However, when it is desired to remove the screwstrip from the feed track, or insert a screwstrip into the feed track, the halves may be rotated apart for easy insertion or removal of the screwstrip.

BRIEF DESCRIPTION OF THE DRAWINGS

The present technology will now be described with reference to the following drawings.

DETAILED DESCRIPTION

The present technology will now be described with reference to FIGS. 1 through 15 which in embodiments relate to a screw advance mechanism and screwstrip feeder mechanism for use in an autofeed power screwdriver. It is understood that the present technology may be embodied in many different forms and should not be construed as being limited to the embodiments set forth herein; rather these embodiments are provided so that this disclosure will be thorough and complete and will fully convey the technology to those skilled in the art. Indeed, the technology is intended to cover alternatives, modifications and equivalents of these embodiments, which are included within the scope and spirit of the technology as defined by the appended claims. Furthermore, in the following detailed description of the present technology, numerous specific details are set forth in order to provide a thorough understanding of the present technology. However, it will be clear to those of ordinary skill in the art that the present technology may be practiced without such specific details.

Figure 1:
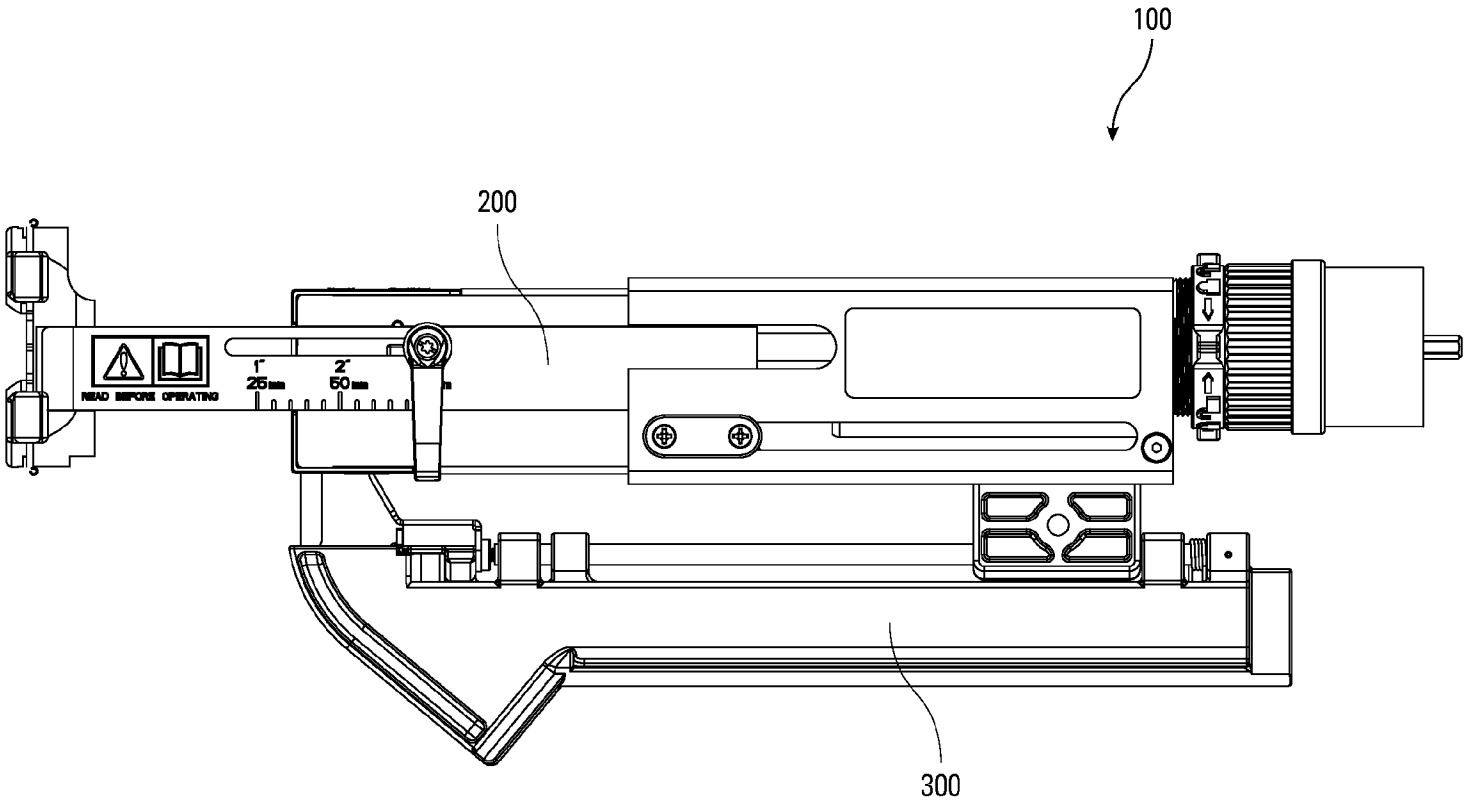
FIG. 1 is a side view of a complete power screwdriver including a screw advance mechanism and a hinged feed track.
Figure 2:
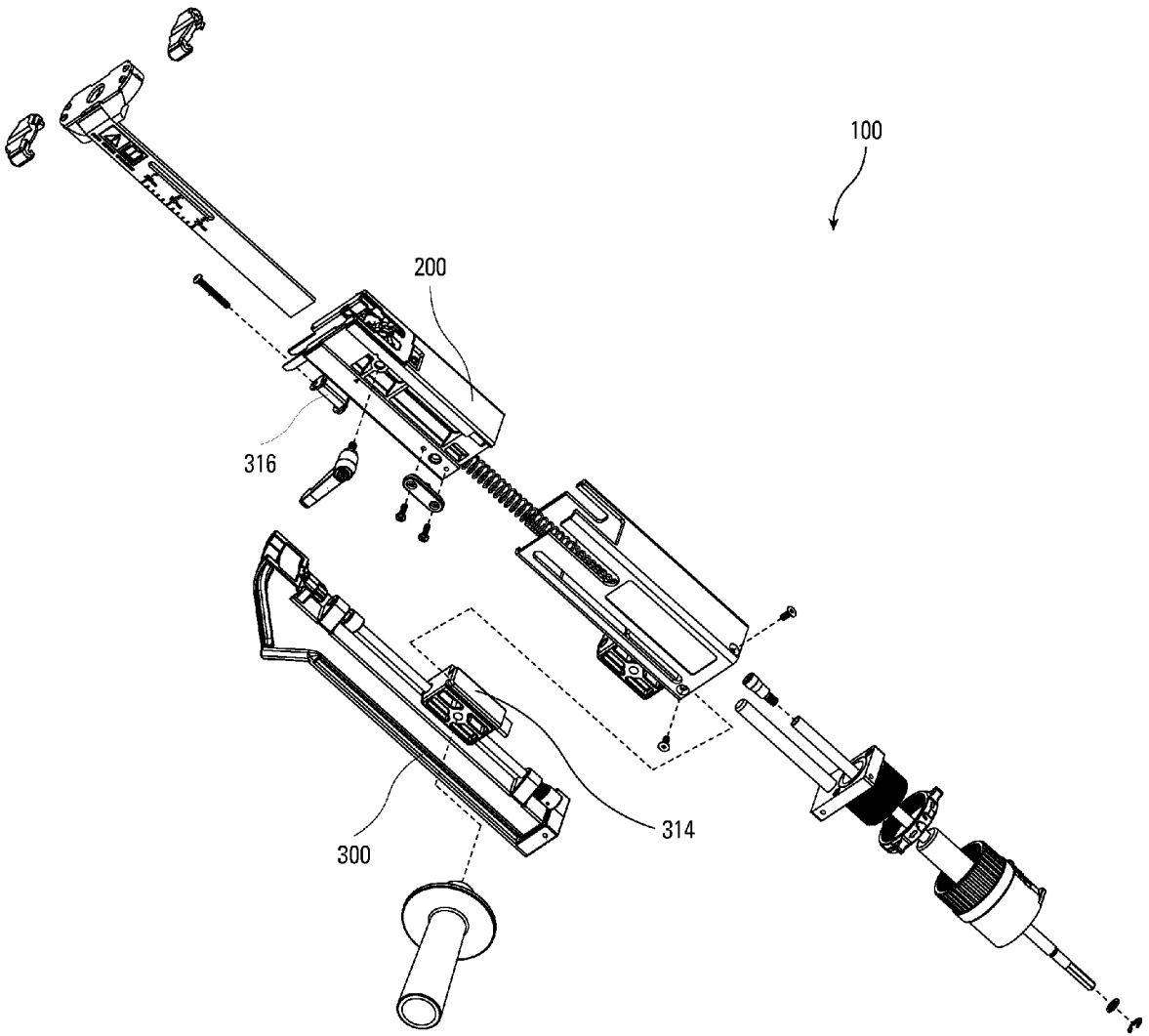
FIG. 2 is an exploded perspective view of internal portions of the power screwdriver including a screw advance mechanism and a feed track.

FIG. 1 shows a side view of a power screwdriver 100 according to embodiments of the present technology. FIG. 2 is an exploded perspective view of internal components of power screwdriver 100. The screwdriver 100 includes a number of assemblies, including a screw advance mechanism 200 and a screwstrip feeder 300. These assemblies are explained in greater detail below.

Screw advance mechanism 200 is now described with reference to FIGS. 3 through 14. As best seen in the exploded perspective view of FIG. 3, the mechanism 200 includes a base enclosure 240 sealable by a cover plate 272 via screw 204 or other fastening system. A feed lever 265 is mounted within base enclosure via fastener 202 within hole 203 so as to pivot at that point. The feed lever includes a first end 266 and a second end 268 opposite end 266. End 266 includes a cam follower driven by a motorized cam (not shown) or other driving mechanism. The cam or driving mechanism pivots the feed lever between a first position, referred to herein as a retracted position (shown in FIG. 4), and a second position, referred to herein as an extended position (shown in FIG. 5).

Figure 4:
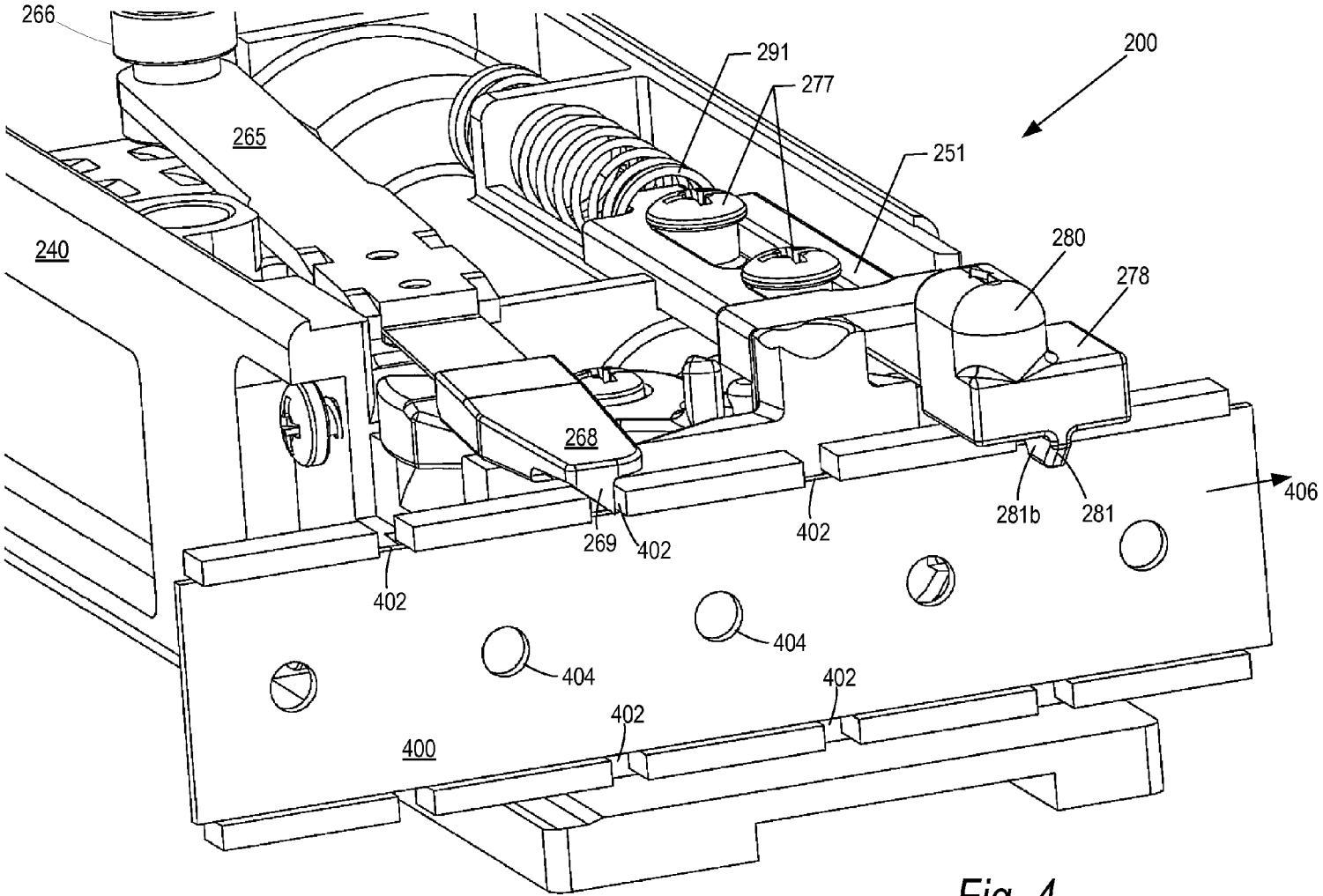
FIG. 4 is an end perspective view of the screw advance mechanism including the feed lever engaged into a screwstrip while the feed lever is in a retracted position.
Figure 5:
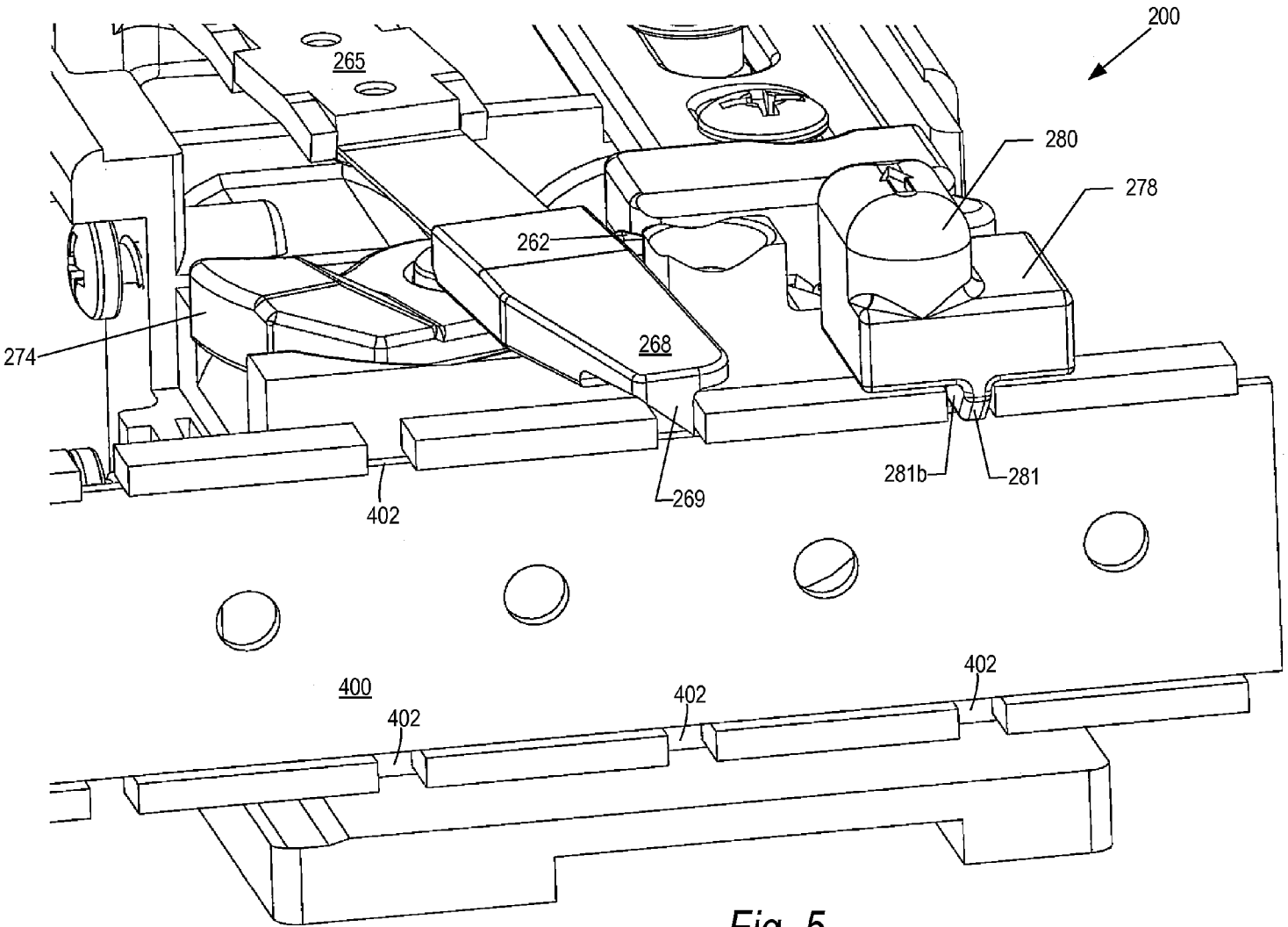
FIG. 5 is an end perspective view of the screw advance mechanism including a feed lever engaged into a slot of a screwstrip while the feed lever is in an extended position.

FIGS. 4 and 5 are end perspective views of the screw advance mechanism including the feed lever 265 advancing a screwstrip 400. The second end 268 of feed lever 265 includes a projection 269 which engages within slots 402 formed in a rail of the screwstrip 400 to advance the screwstrip. The screwstrip shown in FIGS. 4 and 5 is shown with no screws. This condition may exist for example for a leading edge of the screwstrip. However, screwstrip holes 404 upstream of the target position where screws are driven from the screwstrip may have screws. FIG. 4 shows the feed lever 265 in the retracted position, where the projection 269 on end 268 engages within a slot 402 of the screwstrip 400. The feed lever 265 is then pivoted by the drive cam (not shown) acting on end 266 to the extended position shown in FIG. 5, with the projection advancing the screwstrip in the direction of arrow 406 to position the next screw within the screwstrip in the target position.

As indicated above, a leading edge (or some other portion) of the screwstrip 400 may be devoid of screws, as shown in FIGS. 4 and 5. It is a feature of the present technology that the screwstrip may be easily manually pulled through the screw advance mechanism 200 in the direction of arrow 406 to easily position the screwstrip with a screw adjacent to or at the target position. At the same time, the present technology prevents the reverse movement of the screwstrip 400 (opposite the direction of arrow 406). The features of the present technology which enable this unilateral movement are explained hereinafter.

Referring again to FIG. 3, the screw advance mechanism 200 further includes a lifter 250, a clutch slider 251 and a paddle lever 255, which interact with feed lever 265 and each other to ensure accurate and proper advancement of the screwstrip 400. Each of these components is explained below.

Lifter 250 is pivotally mounted within the base enclosure 240 generally beneath the feed lever 265, as seen for example in FIGS. 4-10 and 12-14. The lifter 250 serves two functions. In a first function, when acted on by the feed lever 265, the lifter 250 in turn causes translation of the clutch slider 251 between a first position where the screwstrip 400 may advance and a second position where the screwstrip is locked in place. In a second function, when a screw is located in the target position, the lifter lifts the projection 269 of feed lever 265 away from slots 402 to prevent advancement of the screwstrip by the feed lever.

Figure 3:
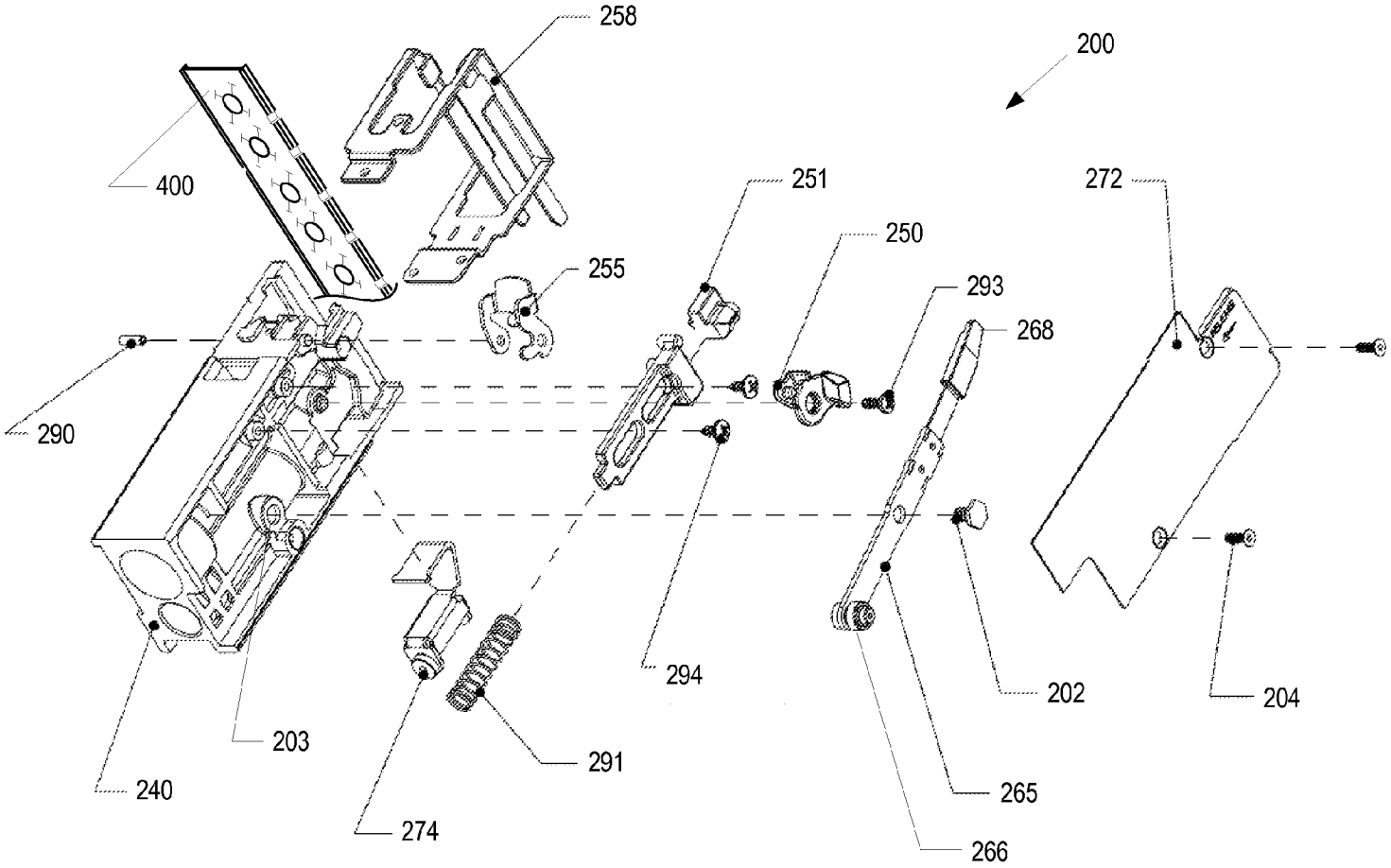
FIG. 3 is an exploded perspective view of components of the screw advance mechanism.
Figure 6:
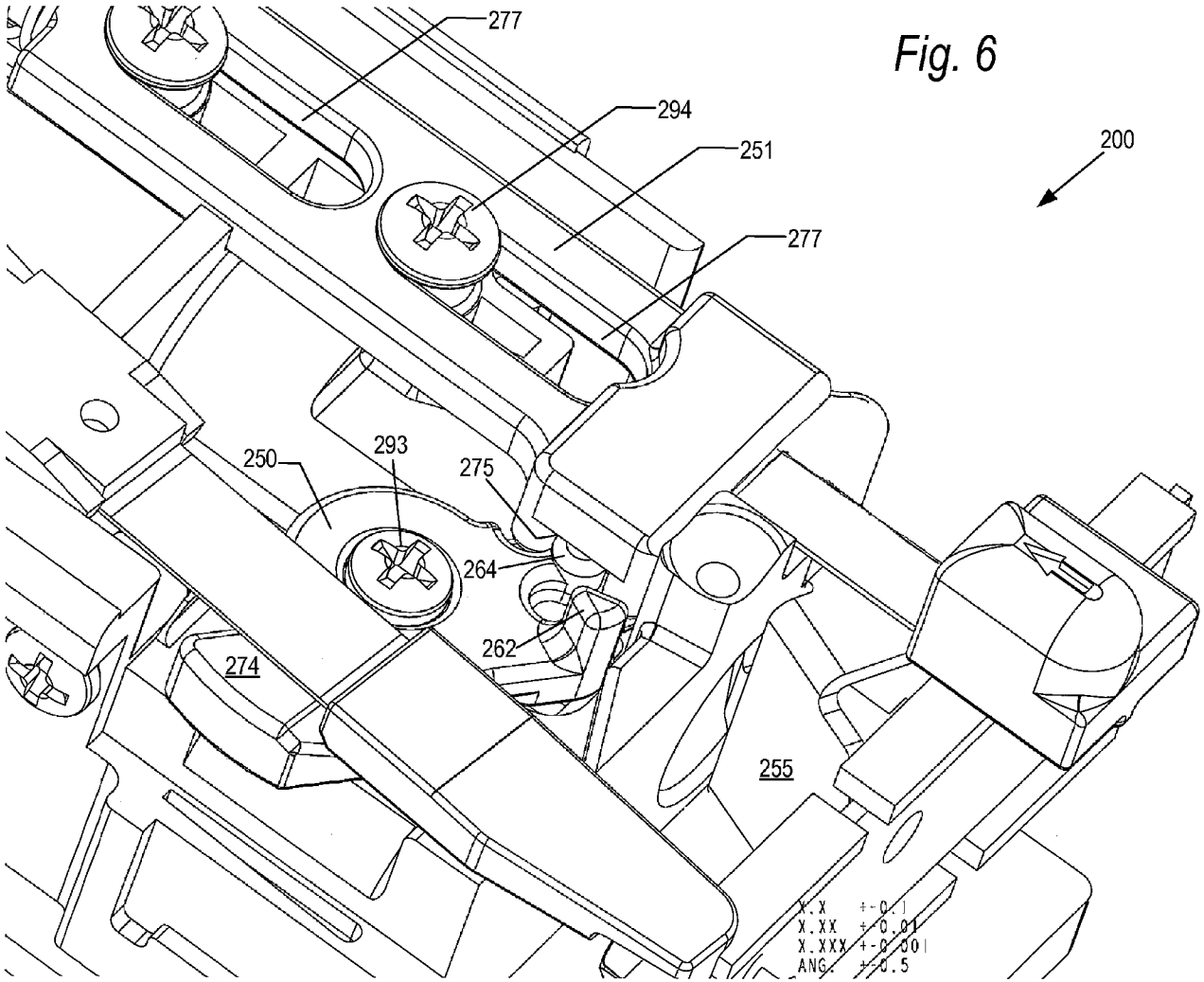
FIG. 6 is a top perspective view of the screw advance mechanism including a cam of a lifter engaging a slot of a clutch slider.
Figure 7:
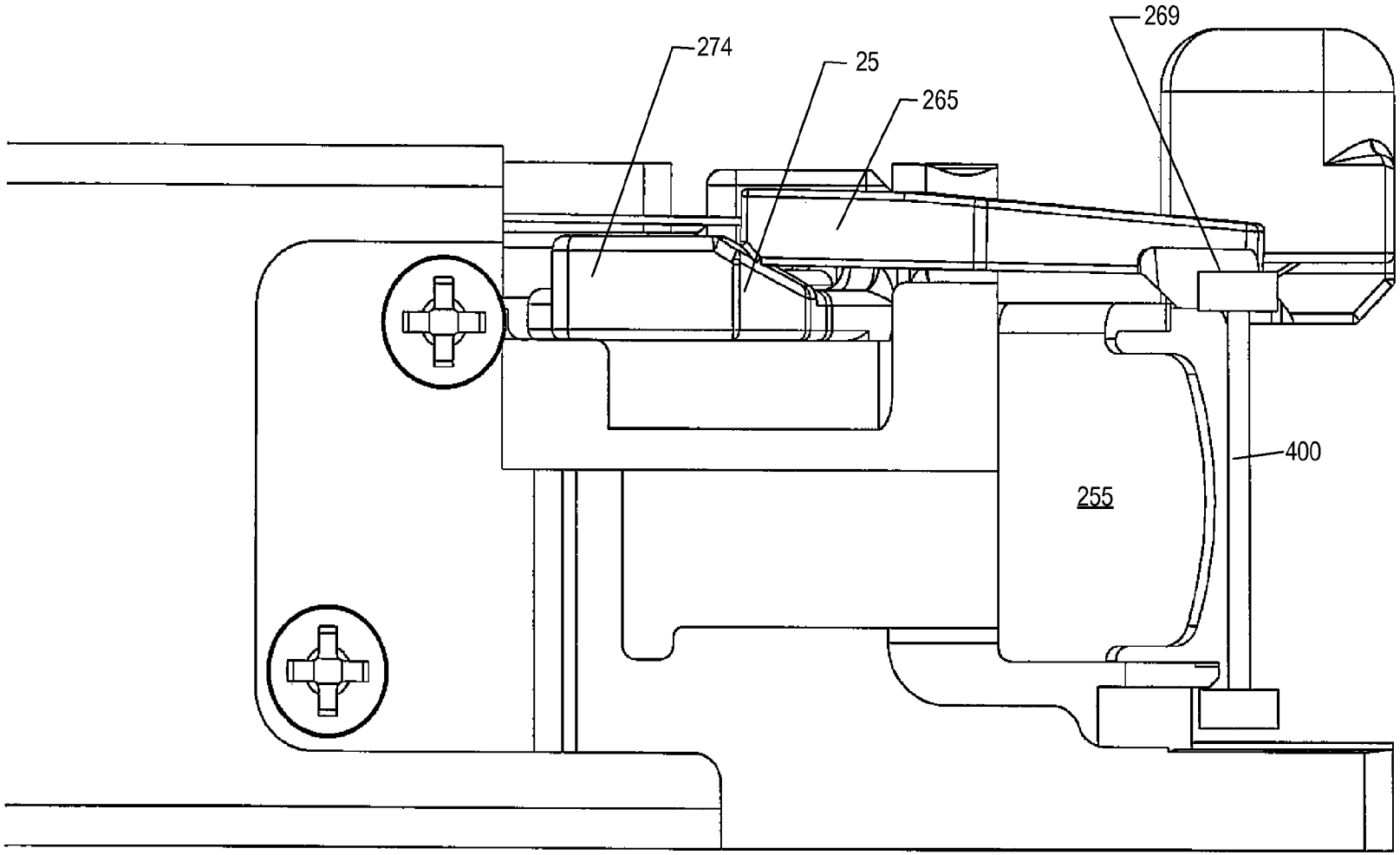
FIG. 7 is an end view of the screw advance mechanism including the lifter allowing engagement of the feed lever into a slot of a screwstrip.
Figure 8:
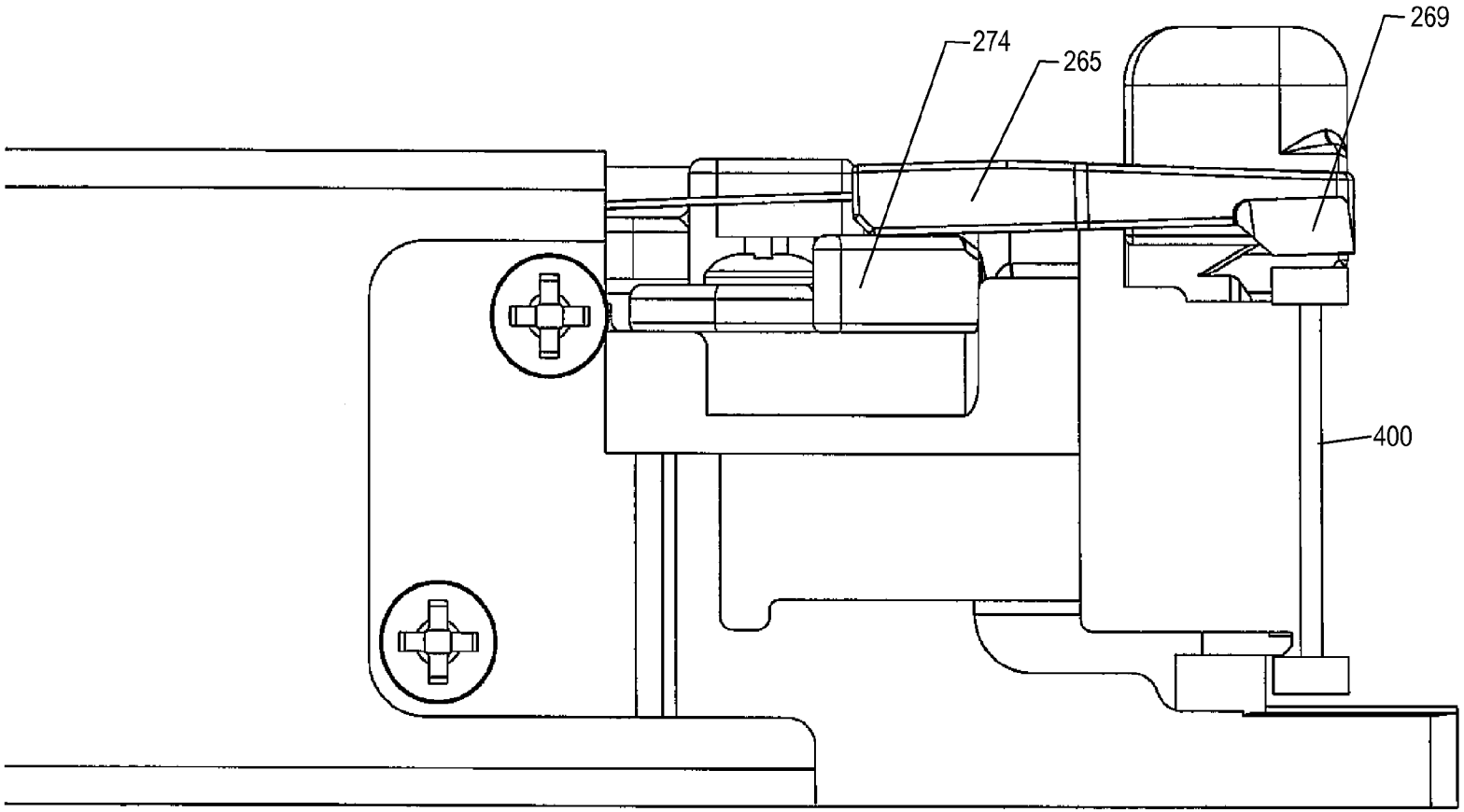
FIG. 8 is an end view of the screw advance mechanism including the lifter disengaging the feed lever from the slots of a screwstrip.

Referring to the first of the above described functions, the lifter 250 is pivotally mounted to the base enclosure 240 via a screw 293 through hole 260 as seen in FIGS. 3 and 6. Lifter 250 further includes a boss 262 and a cam 264. As feed lever 265 pivots from its retracted position, a portion of the feed lever engages boss 262 (FIG. 5) to pivot the lifter 250 counterclockwise. As the lifter 250 pivots, the cam 264 engages a slot 275 in the clutch slider 251 (FIG. 6). As explained below, the clutch slider 251 is mounted for translation, and the engagement of the cam 264 within the slot 275 translates the clutch slider between a first position where the screwstrip 400 may advance and a second position where the screwstrip is locked in place.

Referring now the second function of the lifter 250, the lifter further includes a raised portion 274, seen for example in FIGS. 3-10 and 11-12. As the feed lever 265 engages the screwstrip, the raised portion is retracted and spaced from the feed lever. This position is shown for example in FIGS. 5 and 6 and the end view of FIG. 7. However, at times, for example when a screw in screwstrip 400 is in the target position, the lifter is pivoted to a position where the raised portion 274 slides beneath feed lever 265. This action forces the end 268 of feed lever 265 up out of the plane in which the feed lever rotates to remove the projection 269 of the feed lever out of the slots 402 of the screwstrip 400. This condition is shown for example in the end view of FIG. 8, the perspective view of FIG. 9 and the bottom view of FIG. 10. Disengaged from the slots 402, the feed lever 265 cannot prematurely advance the screwstrip 400 while there is a screw ready to be driven in the target position.

As seen for example in FIGS. 3, 4 and 6, the clutch slider 251 is mounted for translation as a result of the clutch slider being affixed to the base enclosure 240 by a pair of screws 294 or other fasteners riding within slots 277. A spring 291 acts against a base portion of the clutch slider so that the clutch slider translates between three positions explained below.

The first of these positions is referred to herein as the unbiased position. In this position, the only forces acting on the clutch slider are from spring 291, and an end 278 of the clutch slider extends a first extent past the screwstrip 400. This position occurs while the feed lever 265 is in a retracted position, and is shown for example in FIGS. 4 and 6, the end perspective view of FIG. 11 and the top view of FIG. 12.

The second of the three positions is referred to herein as the partially biased position. In this position, the force of cam 264 of lifter 250 in slot 275 overcomes the spring 291 force so that the end 278 of clutch slider 251 extends a second extent past the screwstrip 400, the second extent being less than the first extent. This position occurs for example while the feed lever 265 is in an extended position, and is shown for example in FIGS. 5, 9 and the bottom view of FIG. 10.

Figure 14:
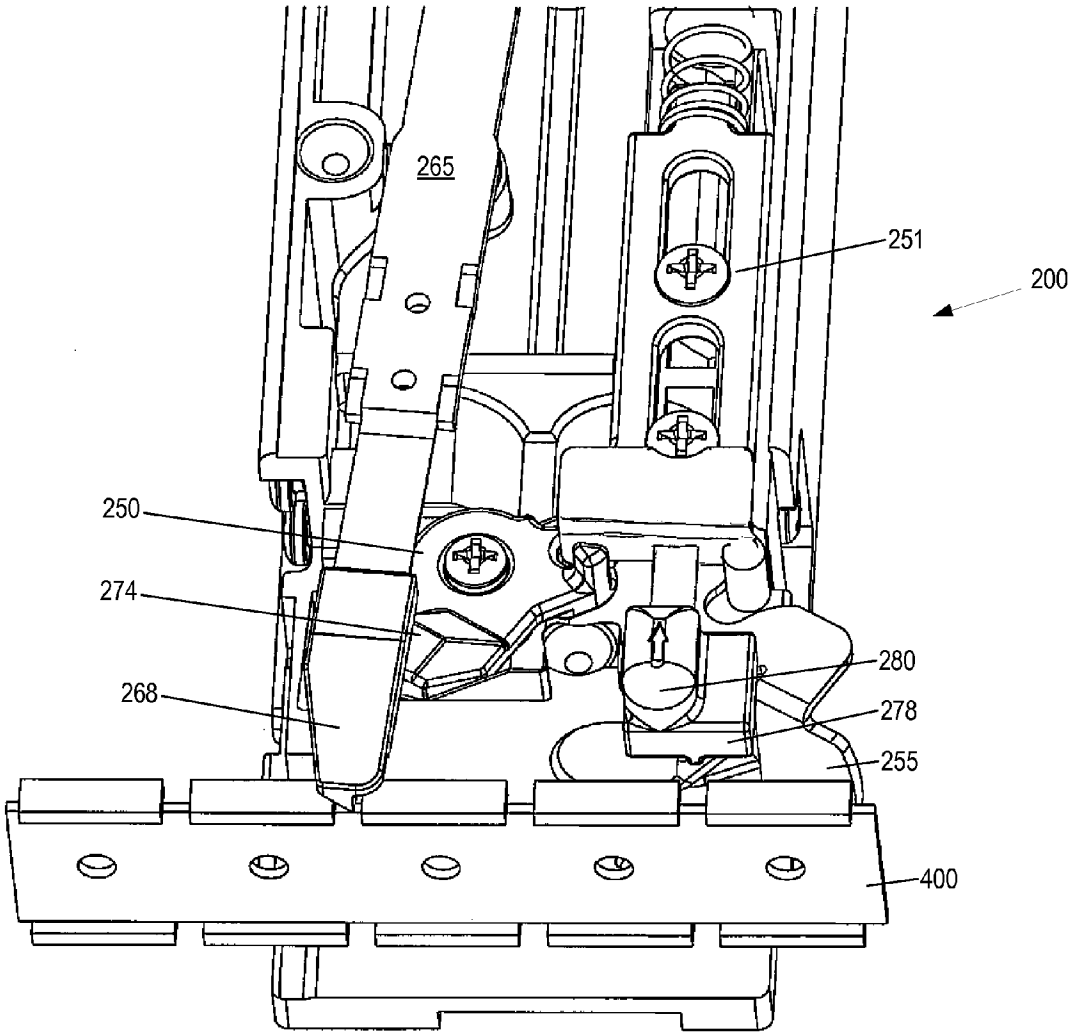
FIG. 14 is a bottom perspective view of the screw advance mechanism in the manual release position.
Figure 15:
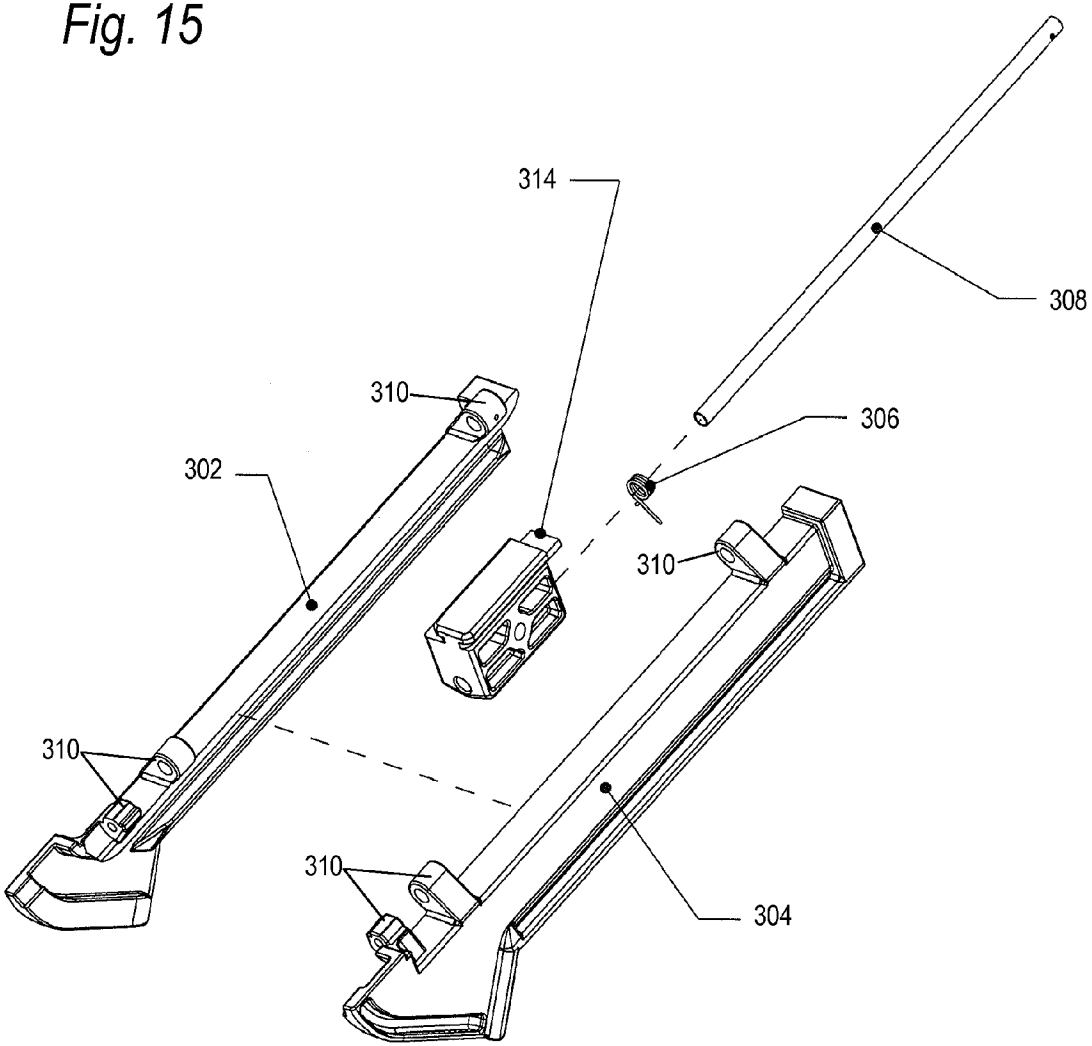
FIG. 15 is an exploded perspective view of the feed track.

The third position is referred to herein as the fully biased position. In this position, the end 278 of the clutch slider 251 is manually pushed down clear of the screwstrip 400 as a result of a user manipulating finger grip 280. This condition is shown in FIG. 14.

Figure 10:
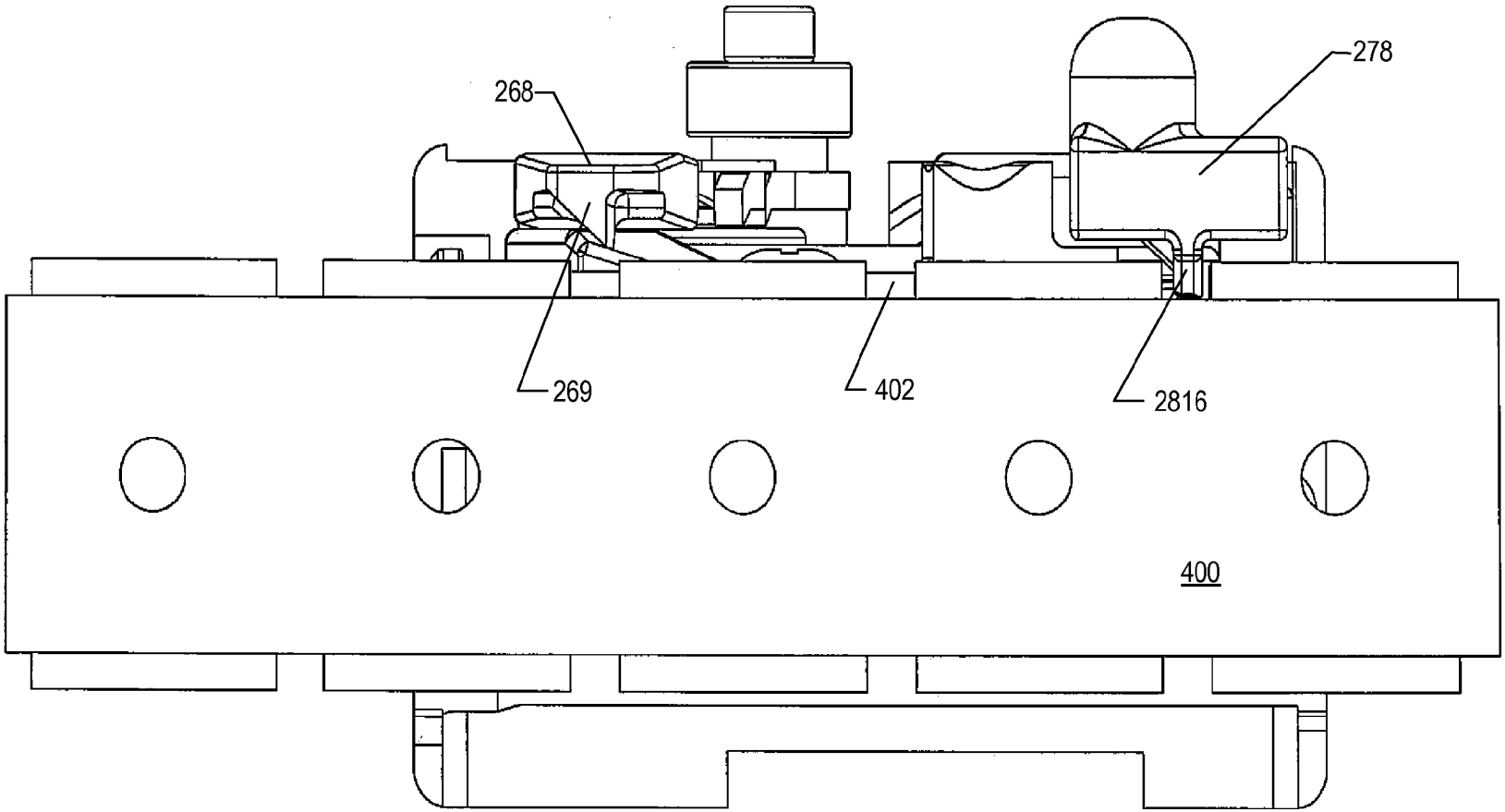
FIG. 10 is a bottom view of the screw advance mechanism including the clutch slider engaged within a slot of a screwstrip to lock the screwstrip in place.
Figure 11:
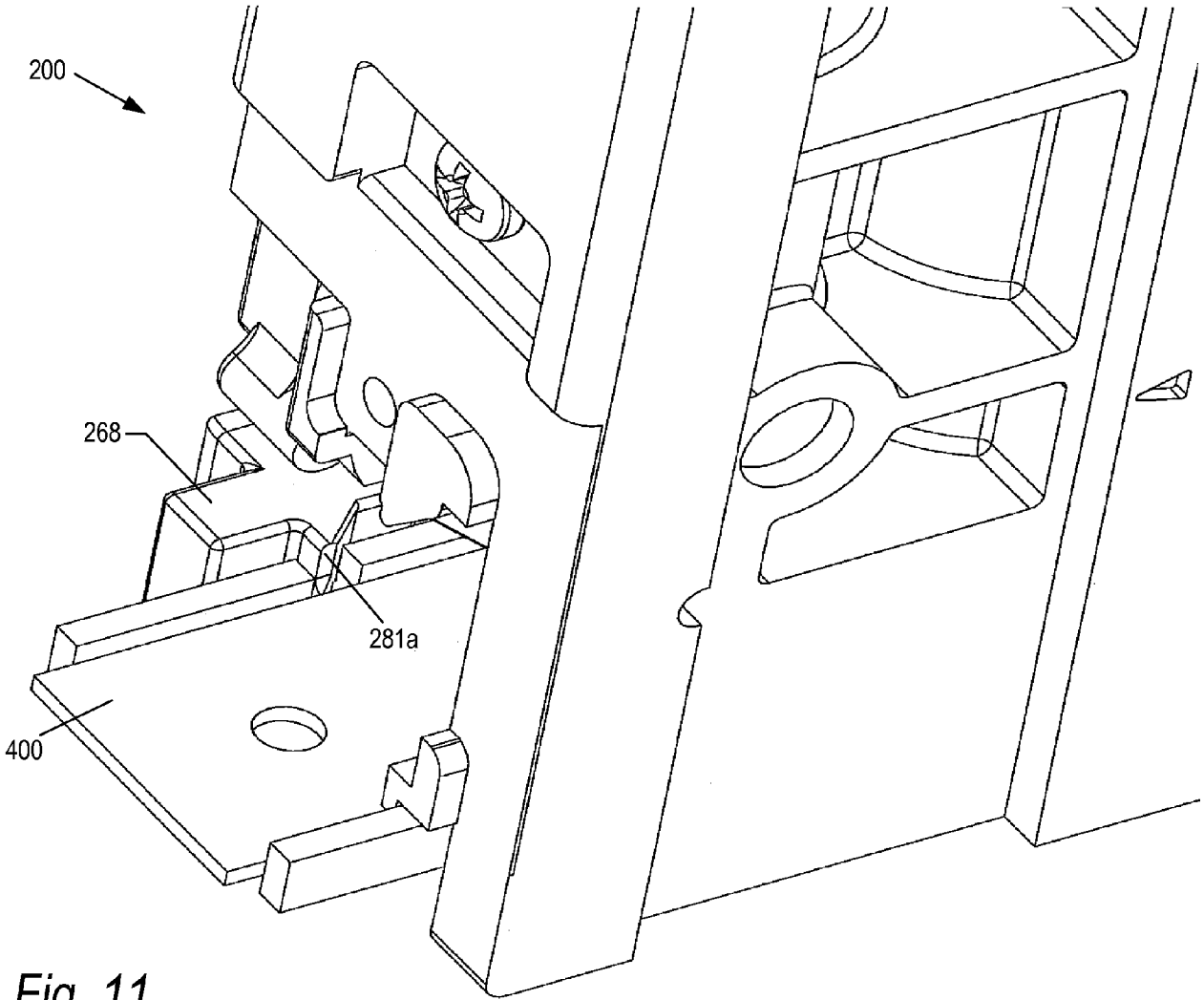
FIG. 11 is an end perspective view of the screw advance mechanism including the clutch slider engaged within a slot of a screwstrip to allow one-way movement of the screwstrip.

The clutch slider 251 may perform three different functions, each associated with one of the three above-described positions of the clutch slider 251. The first of these functions is now described with reference to FIGS. 4 and 11. The end 278 includes a projection 281 extending the length of end 278, generally perpendicularly with the screwstrip 400. The projection 281 includes two different profiles, 281*a* and 281*b*. Profile 281*a* is proximal of profile 281*b* (i.e., profile 281*a* is spaced a greater distance from the distal tip of end 278 than profile 281*b*). As seen in FIG. 11, profile 281*a* has a first surface which is generally flat and parallel to the opposed sidewalls which define the slots 402. Profile 281*a* further includes a second surface opposite the first surface and formed at an inclined angle with respect to the sidewalls of slots 402. The second profile 281*b* of projection 281 continues from profile 281*a*, distally of profile 281*a*. As seen in FIG. 10, profile 281*b* includes first and second opposed surfaces, which are both generally flat, and parallel to each other and the sidewalls of slot 402.

The spacing between projection 269 on feed lever 265 and projection 281 on clutch slider 251 is controlled so that, when the feed lever 265 is in the retracted position and the clutch slider is in the unbiased position, the projection 281 of the clutch slider 251 rests within a slot of the screwstrip 400. As the clutch slider is in the unbiased position, profile 281*a* engages with the screw strip slot 402 (FIGS. 4 and 11). The first surface of profile 281*a* is flat and parallel to the sidewalls of slot 402. As such, the first surface of profile 281*a* prevents relative movement of the screwstrip to the screw advance mechanism 200 in a direction opposite arrow 406 (FIG. 4). This prevents the screwstrip from being pulled out of the screw advance mechanism 200.

However, as the second surface of profile 281*a* is inclined, a force on the screwstrip 400 in the direction of arrow 406 will allow the inclined surface of profile 281*a* to ride up out of the slot 402, and allow relative movement between the clutch slider 251 and the screwstrip 400. This allows the screwstrip to be advanced in the direction of arrow 406 when the clutch slider is in the unbiased position.

If a screw is present in the target zone, the paddle lever 255 moves the clutch slider to its partially biased position, where the profile 281*b* locks within a slot and prevents relative movement in either direction. This feature is explained below. However, where no screw is present at the target zone, the clutch slider having profile 281*a* with an inclined surface allows the screwstrip to be freely and easily advanced. This feature of the present technology allows easy loading of the screwstrip.

As indicated above, the spacing between projection 269 on feed lever 265 and projection 281 on clutch slider 251 is controlled so that, when the feed lever 265 is in the retracted position and the clutch slider is in the unbiased position, the projection 281 of the clutch slider 251 rests within a slot 402 of the screwstrip 400. In addition to controlling this spacing, the arc length over which projection 269 on feed lever 265 pivots (and accordingly the distance with which the screwstrip is advanced) is controlled so that, when the feed lever 265 pivots to the extended position, the projection 281 on clutch slider 251 again rests within a slot 402. This slot is one slot advanced of the slot the projection 281 rested in when the feed lever 265 was in the retracted position.

Figure 9:
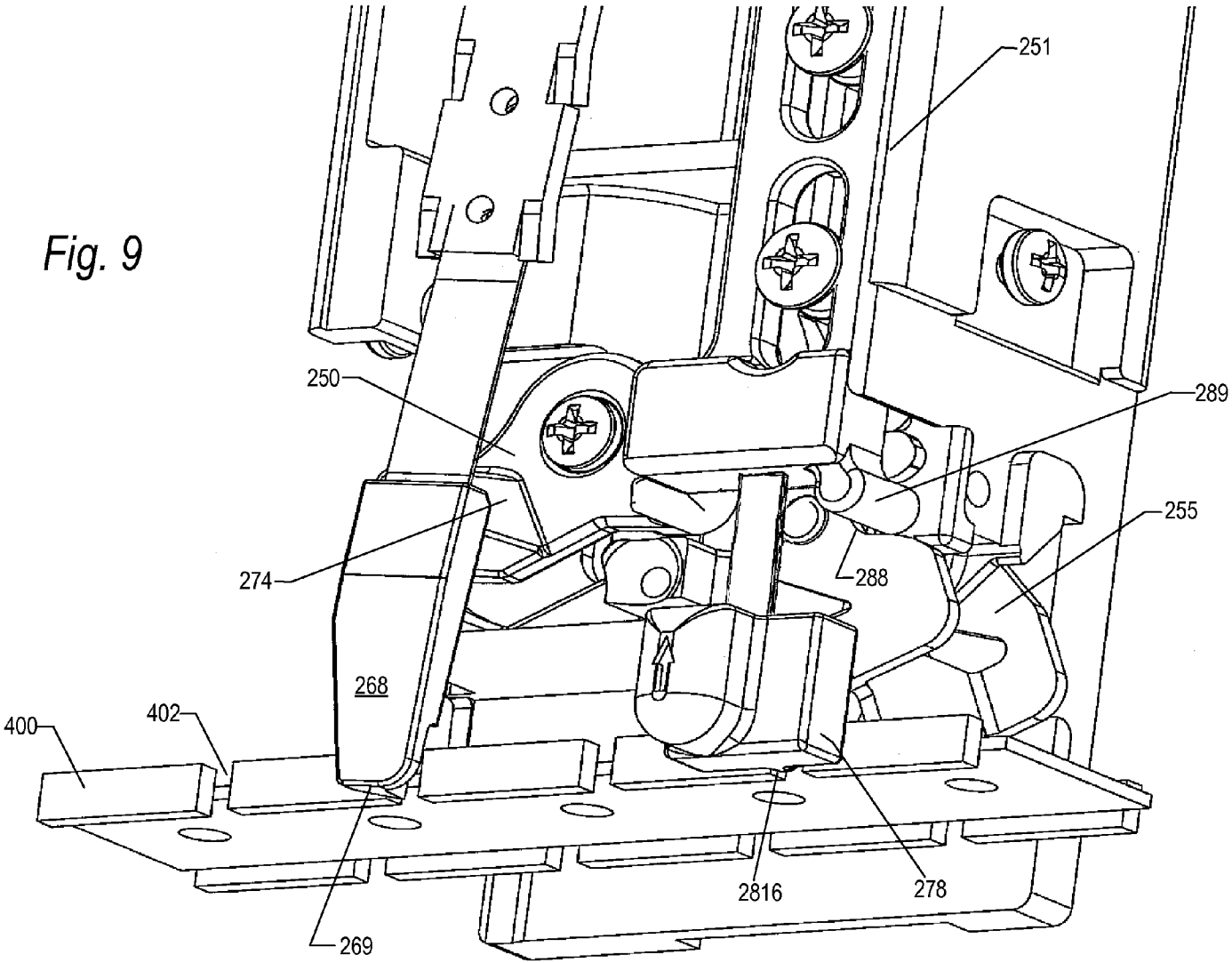
FIG. 9 is a top perspective view of the engagement of a cam of a paddle lever engaged with a slot of the clutch slider.

As described above, as the feed lever 265 pivots, the feed lever acts on the lifter 250, which in turn translates the clutch slider 251 relative to the screwstrip 400 to move the clutch slider from its unbiased position to its partially biased position. This translation changes which profile engages within the slot 402. In particular, when the feed lever 265 completes its pivot stroke, the profile 281*b* then engages within the next slot 402 (FIGS. 5, 9 and 10). As the first and second surfaces opposed surfaces of profile 281*b* are generally flat and parallel to each other and the sidewalls of a slot 402, the profile 281*b* engaged within a slot prevents relative movement of the screwstrip with respect to the screw advance mechanism 200 in either direction. The distance between the first and second opposed surfaces on profile 281*b* is slightly smaller than the diameter of a slot 402, so that the profile 281*b* easily enters a slot 402, but prevents relative movement within the tolerance of the powered screwdriver to engage a screw in the target position.

When the feed lever 265 pivots to advance the screwstrip, the inclined surface of profile 281*a* allows the projection 281 to ride up out of the slot in which it is engaged so that the screwstrip 400 can advance to the next position. As explained above, as the feed lever 265 moves from its retracted position to its extended position, the clutch slider 251 is biased downward from its unbiased position (profile 281*a* engaging a first slot 402) to its partially biased position (profile 281*b* engaging within the next adjacent slot 402). Thus, the relative sizing of profile 281*a* and 281*b* on projection 281 are controlled so that, during pivoting of the feed lever 265, the projection 281 does not transition from profile 281*a* to 281*b* until the inclined surface of profile 281*a* is cleared of a slot 402.

The above sections describe how the clutch slider 251 is moved from its unbiased position to its partially biased position by the feed lever 265 as it pivots. However, as indicated above, it is a feature of the present technology to allow manual advancement of the screwstrip without pivoting of the feed lever 265. In such instances, it would be disadvantageous to allow the screwstrip to be advanced so that a screw in the screwstrip is pulled past the target position without being inserted into the workpiece. Therefore, in accordance with a further aspect of the present technology, the screw advance mechanism 200 further includes the paddle lever 255 to move the clutch slider 251 to the partially biased position (where it locks into a slot 402) to prevent a screw 420 from being advanced past the target zone.

Figure 12:
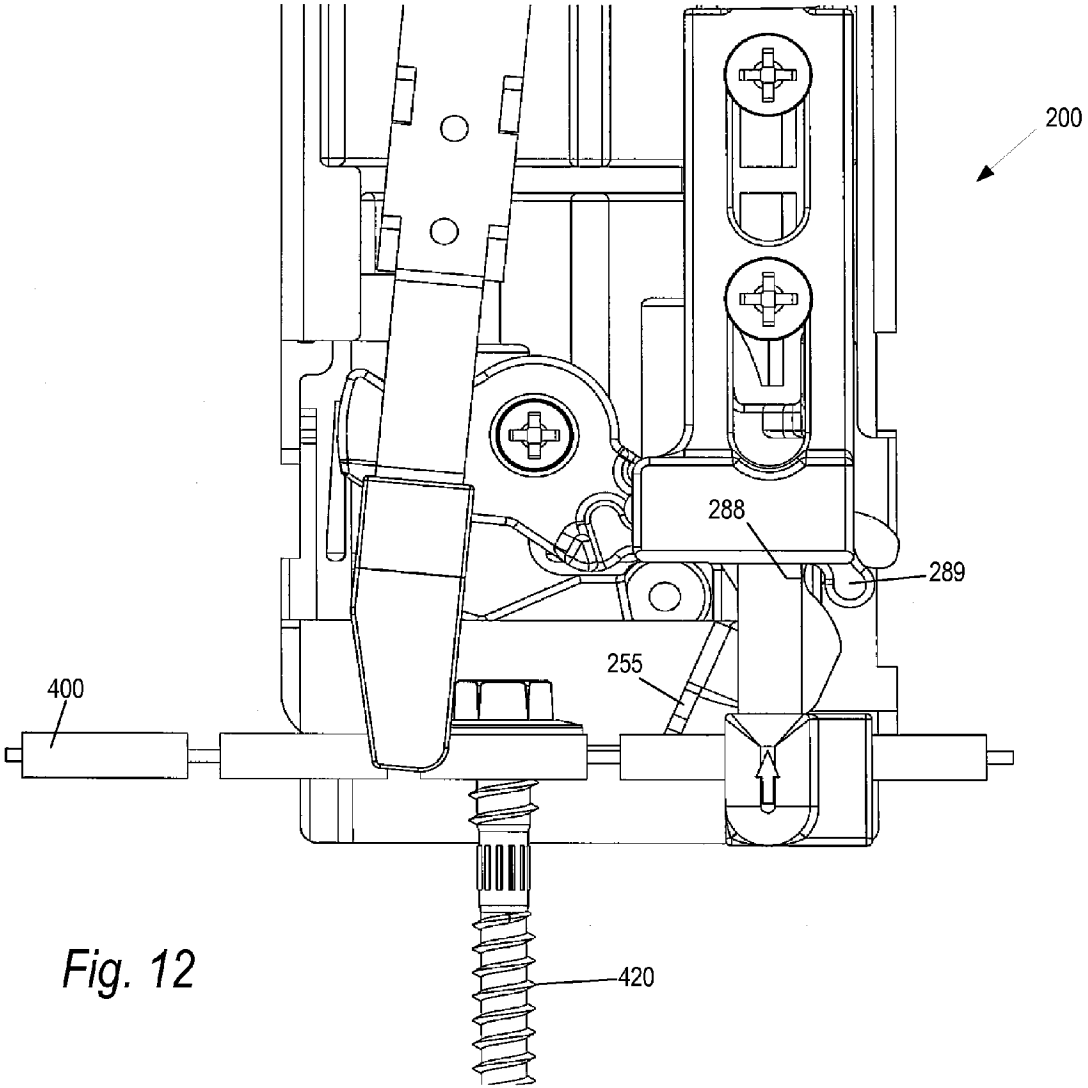
FIG. 12 is a top view of the screw advance mechanism including the paddle lever before engagement with the next screw.
Figure 13:
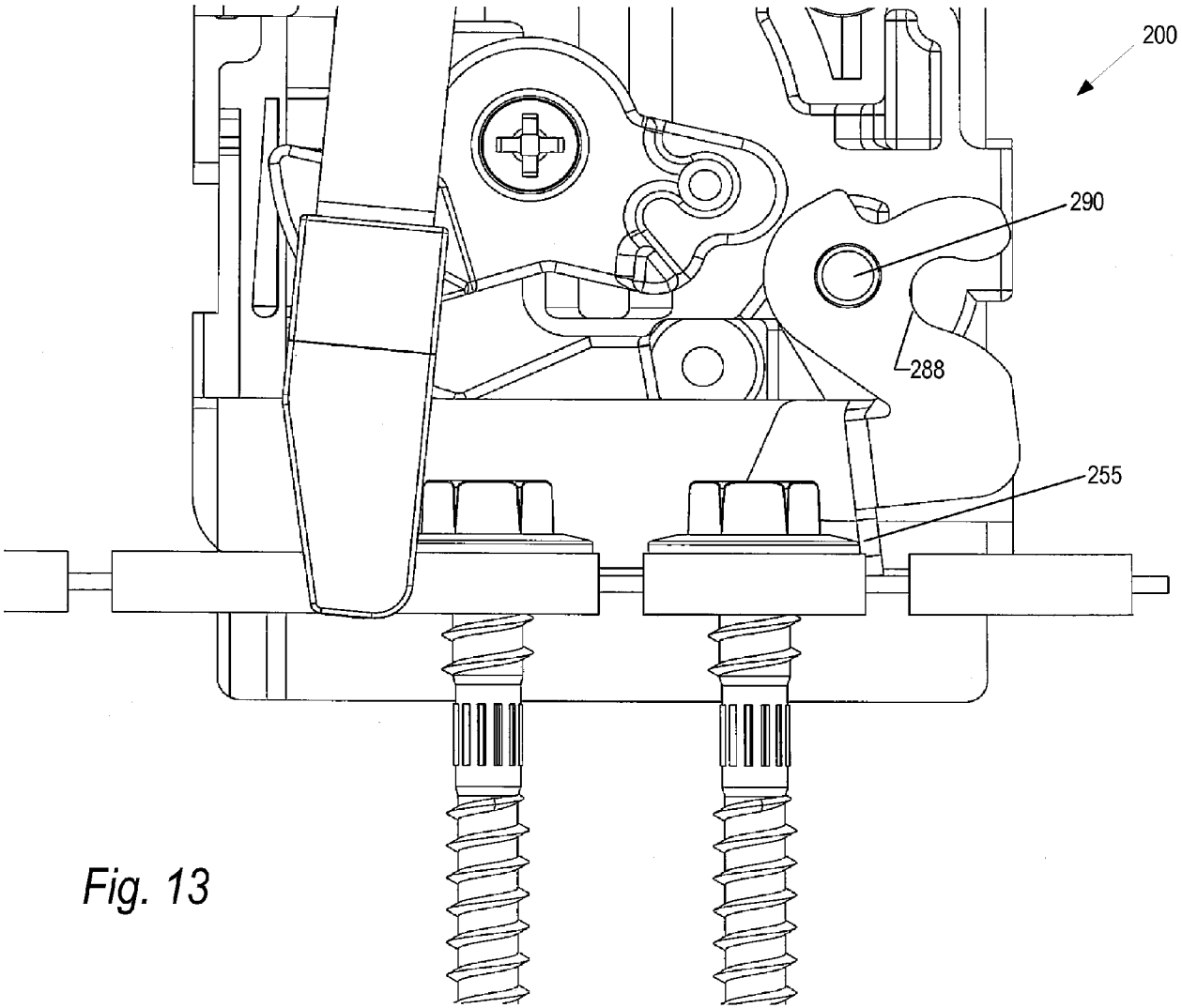
FIG. 13 is a top view of the screw advance mechanism including the paddle lever engaging the next screw.

As seen in FIGS. 3, 12 and 13, the paddle lever 255 is pivotally mounted to the base enclosure 240 via a pin 290 which mounts to the base enclosure through holes 286 in the paddle lever 255. The paddle lever 255 further includes a slot 288 for biasing a shoulder 289 on the clutch slider 251 to bias the clutch slider 251 from the unbiased position to the partially biased position. This feature is explained below.

In an unbiased position, the paddle lever 255 resides approximately between 7 and 8 o'clock (using an analogy of the small hand of a clock) from the perspective of FIG. 12. However, upon a screw in the screwstrip advancing to the target position, the screw pivots the paddle lever to 6 o'clock or slightly past, as seen in FIG. 13. The shoulder 289 resides within slot 288, and upon counterclockwise pivoting of the paddle lever 255 by a screw, the slot 288 biases the shoulder 289 and clutch slider 251 from the unbiased position to the biased position. As explained above, when in the biased position, the profile 281*b* of projection 281 prevents movement of the screwstrip in either direction. Thus, when a screw moves into the target position, it pivots the paddle lever 255, which in turn biases the clutch slider 251 to a position where it locks the screwstrip 400 in place so that the screw in the target position may be driven into the workpiece. This prevents overfeeding.

There are times when it is desired to manually release the screw advance mechanism 100 from any engagement with the screwstrip so that the screwstrip may be withdrawn or repositioned (even if there are screws that pass through the target position upon such repositioning). In accordance with a further aspect of the present technology, the clutch slider 251 includes a finger grip 280 (FIGS. 4, 5 and 14) for a user to manually move the clutch slider 251 to a fully retracted position. The fully retracted position is shown in FIG. 14.

In a fully retracted position, the projection 281 of the clutch slider 251 is completely disengaged from the slots 402 in the screwstrip. Additionally, such translation of the clutch slider pivots the lifter 250 so that raised section 274 is positioned beneath the feed lever 265 to disengage end 268 of the feed lever from the slots 402. Further still, the translation of the clutch slider to the fully retracted position pivots the paddle lever 255 to a position where screws may pass by the paddle lever without contact there between. In this way, none of the above-described components of the screw advance mechanism engage the screwstrip 400 or screws in the screwstrip. This allows the screwstrip to be feely advanced in either direction.

Referring again to FIGS. 1 and 2, the feed track 300 may be mounted adjacent the screw advance mechanism 200. It is advantageous to provide a feeding track to guide and feed the screwstrip 400 into the screw advance mechanism 200. However, conventional feed tracks make it difficult to insert a screwstrip into the feed track or remove a screwstrip from the feed track. In accordance with a further aspect of the present technology described with respect to FIGS. 2 and 15, the feed track may be formed of two separate halves 302 and 304. The halves may be positioned adjacent to each other and biased together by one or more springs 306 mounted along a hinge 308 to which the two feeder halves 302, 304 are mounted. The halves may have brackets 310 with holes for receiving the hinge 308 to affix the halves together as shown in FIG. 2.

The spring(s) 306 contact the halves 302, 304 to maintain the halves against each other in a fixed position during operation of the power screwdriver to guide the screwstrip into the screw advance mechanism. However, when it is desired to insert the screwstrip into the feed track 300 or remove the screwstrip from the feed track 300, the feeder halves 302, 304 may be manually separated by rotating the halves away from each other about an axis of the hinges. The screwstrip may then be positioned or removed, and the halves released to return to their operating position adjacent each other. The feed track may be affixed adjacent the screw advance mechanism via a connector 314. A connector 316 (FIG. 2) may also be formed on a surface of screw advance mechanism 200 for receiving an end of hinge 308 to further affix the feed track 300 in position.

The foregoing detailed description of the technology has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claims appended hereto.

What is claimed is:

1. An advance mechanism for a power screwdriver, the power screwdriver capable of driving screws from a screwstrip into a workpiece, the advance mechanism comprising:

a feed lever for engaging and advancing the screwstrip; and a clutch slider for locking the screwstrip in a fixed position upon advance of the screwstrip by the feed lever.

2. The advance mechanism recited in claim 1, the clutch slider further allowing advance of the screwstrip in a first direction and preventing advance of the screwstrip in a second direction opposite the first direction when the clutch slider is not locking the screwstrip in a fixed position.

3. The advance mechanism recited in claim 2, the clutch slider including a protrusion with first and second profiles, the clutch slider occupying a first relation to the screwstrip where the first profile engages the screwstrip to allow advance of the screwstrip in the first direction and not the second direction, and the clutch slider occupying a second relation to the screwstrip where the second profile engages the screwstrip to lock the screwstrip in a fixed position with respect to the clutch slider.

4. The advance mechanism recited in claim 3, the clutch slider further occupying a third relation to the screwstrip where the first and second profiles are disengaged from the screwstrip.

5. The advance mechanism recited in claim 2, the advance mechanism further including a paddle lever for preventing the advance of the screwstrip in the first direction upon a screw in the screwstrip engaging the paddle lever.

6. The advance mechanism recited in claim 5, the paddle lever moving between a first position when not engaged by a screw and a second position engaged by the screw, the paddle lever moving the clutch slider to the second relation with respect to the screwstrip when the paddle lever is in the second position.

7. The advance mechanism recited in claim 1, further comprising a lifter, interposed between the feed lever and the clutch slider, the feed lever capable of actuating the lifter and the lifter capable of actuating the clutch slider.

8. The advance mechanism recited in claim 7, the lifter further capable of lifting the feed lever away from the screwstrip to disengage the feed lever from the screwstrip.

9. An advance mechanism for a power screwdriver, the power screwdriver capable of driving screws from a screwstrip into a workpiece, the advance mechanism comprising:

a clutch slider moving between a first position, a second position and a third position, the clutch slider allowing advance of the screwstrip in a first direction and preventing advance of the screwstrip in a second direction opposite the first direction when in the first position, the clutch slider locking the screwstrip in a fixed position when in the second position, and the clutch slider allowing advance of the screwstrip in the first and second directions when in the third position.

10. The advance mechanism recited in claim 9, the clutch slider including a protrusion with first and second profiles, the first profile engaging the screwstrip when the clutch slider is in the first position, the second profile engaging the screwstrip when the clutch slider is in the second position, and neither the first or second profiles engaging the clutch slider when the clutch slider is in the third position.

11. The advance mechanism recited in claim 9, the advance mechanism further including a feed lever for advancing the screwstrip.

12. The advance mechanism recited in claim 11, the advance mechanism further including a paddle lever for preventing the advance of the screwstrip in the first direction upon a screw in the screwstrip engaging the paddle lever.

13. The advance mechanism recited in claim 12, the paddle lever moving between a first position when not engaged by a screw and a second position engaged by the screw, the paddle lever moving the clutch slider to the second relation with respect to the screwstrip when the paddle lever is in the second position.

14. The advance mechanism recited in claim 13, wherein the clutch slider and feed lever do not engage the screwstrip, and the paddle lever does not engage a screw in the screwstrip, when the clutch slider is in the third position.

15. The advance mechanism recited in claim 9, further comprising a lifter, interposed between the feed lever and the clutch slider, the feed lever capable of actuating the lifter and the lifter capable of actuating the clutch slider.

16. The advance mechanism recited in claim 15, the lifter further capable of lifting the feed lever away from the screwstrip to disengage the feed lever from the screwstrip when the clutch slider is in at least one of the second and third positions.

17. A power screwdriver capable of driving screws from a screwstrip into a workpiece, the power screwdriver comprising:

a feed track for feeding the screwstrip through the power screwdriver, the feed track including:

a first half, a second half, a hinge for pivotally mounting the first and second halves together, and a biasing mechanism for biasing the first and second halves together into a position for enclosing a screwstrip.

* * * * *